US009301341B2

(12) United States Patent
Riley et al.

(10) Patent No.: US 9,301,341 B2
(45) Date of Patent: Mar. 29, 2016

(54) MEDIUM VOLTAGE HEATING ELEMENT ASSEMBLY

(71) Applicant: Chromalox, Inc., Pittsburgh, PA (US)

(72) Inventors: Michael D. Riley, Kaysville, UT (US); Paul R. Neilson, Pleasant View, UT (US); Martin P. Konieczny, Roy, UT (US)

(73) Assignee: CHROMALOX, INC., Pittsburgh, PA (US)

( * ) Notice: Subject to any disclaimer, the term of this patent is extended or adjusted under 35 U.S.C. 154(b) by 132 days.

(21) Appl. No.: 13/802,842

(22) Filed: Mar. 14, 2013

(65) Prior Publication Data

US 2014/0263282 A1 Sep. 18, 2014

(51) Int. Cl.

| | |
|---|---|
| ***H05B 3/02*** | (2006.01) |
| ***H05B 3/44*** | (2006.01) |
| ***H05B 3/06*** | (2006.01) |
| ***H05B 3/48*** | (2006.01) |
| ***H05B 3/80*** | (2006.01) |

(52) U.S. Cl.

CPC .. *H05B 3/06* (2013.01); *H05B 3/44* (2013.01); *H05B 3/48* (2013.01); *H05B 3/80* (2013.01); *H05B 2203/021* (2013.01)

(58) Field of Classification Search

CPC ..... H05B 3/02; H05B 3/48; B05B 3/48; B05B 3/10; B05B 3/40

USPC ..... 219/542, 546, 544, 548, 552, 553

See application file for complete search history.

(56) References Cited

U.S. PATENT DOCUMENTS

| | | | | | |
|---|---|---|---|---|---|
| 1,715,287 | A | * | 5/1929 | Head | 338/285 |
| 1,738,026 | A | * | 12/1929 | Wennagel et al. | 338/241 |
| 2,091,839 | A | * | 8/1937 | Tangeman | 29/614 |
| 2,508,512 | A | | 5/1950 | Grinde | |
| 2,639,359 | A | * | 5/1953 | Glenn | H05B 3/42 219/528 |
| 3,468,023 | A | * | 9/1969 | McOrlly | 29/615 |
| 3,548,159 | A | * | 12/1970 | Ellstroem | 219/535 |
| 3,812,580 | A | | 5/1974 | Drugmand | |
| 3,846,621 | A | * | 11/1974 | Roos | 219/550 |
| 3,898,431 | A | | 8/1975 | House et al. | |
| 3,928,909 | A | * | 12/1975 | Saku | 29/611 |
| 4,017,713 | A | * | 4/1977 | Lodi | 219/243 |

(Continued)

FOREIGN PATENT DOCUMENTS

| | | | |
|---|---|---|---|
| CH | 339681 | A | 7/1959 |
| DE | 202011105348 | U1 | 11/2011 |

(Continued)

OTHER PUBLICATIONS

International Search Report PCT/US2014/015034, dated May 26, 2014.

*Primary Examiner* — Tu B Hoang
*Assistant Examiner* — Alba Rosario-Aponte
(74) *Attorney, Agent, or Firm* — K&L Gates LLP

(57) ABSTRACT

A medium-voltage heating element assembly. The medium-voltage heating element assembly can include a dual core having an inner core and an outer core. Segments comprising the inner core and the outer core can be staggered. Furthermore, the dual core can include a notch-and-groove interface to prevent axial rotation of the inner core and/or inner core segments relative to the outer core and/or outer core segments. A bushing of the heating element assembly can include a stepped region, and the bushing can interface with the dual core along the stepped region.

21 Claims, 10 Drawing Sheets

(56) References Cited

U.S. PATENT DOCUMENTS

| | | | | | |
|---|---|---|---|---|---|
| 4,033,028 | A * | 7/1977 | Howie | H01B 7/16 29/611 |
| 4,100,397 | A * | 7/1978 | Kunimi | 219/512 |
| 4,934,831 | A | 6/1990 | Volbrecht | |
| 5,072,093 | A | 12/1991 | Scheuerer | |
| 5,097,100 | A | 3/1992 | Jackson | |
| 5,136,143 | A * | 8/1992 | Kutner | H05B 3/46 219/523 |
| 5,218,185 | A | 6/1993 | Gross | |
| 5,245,161 | A * | 9/1993 | Okamoto | F16L 53/008 219/535 |
| 5,401,937 | A | 3/1995 | Nagano | |
| 5,486,682 | A | 1/1996 | Rysemus | |
| 5,536,478 | A | 7/1996 | Lipp et al. | |
| 5,558,794 | A | 9/1996 | Jansens | |
| 5,811,761 | A | 9/1998 | Kita et al. | |
| 5,897,806 | A * | 4/1999 | Watanabe | H05B 3/08 219/541 |
| 6,002,117 | A | 12/1999 | Pak | |
| 6,137,084 | A | 10/2000 | Thomas | |
| 6,160,246 | A | 12/2000 | Rock et al. | |
| 6,172,345 | B1 | 1/2001 | Dial et al. | |
| 6,188,051 | B1 | 2/2001 | Kusek | |
| 6,373,034 | B1 | 4/2002 | Rock et al. | |
| 6,414,286 | B2 | 7/2002 | Rock et al. | |
| 6,459,074 | B1 | 10/2002 | Michelbach et al. | |
| 6,501,055 | B2 | 12/2002 | Rock et al. | |
| 6,781,081 | B2 | 8/2004 | Groos et al. | |
| 6,835,913 | B2 | 12/2004 | Duncan et al. | |
| 7,180,037 | B2 | 2/2007 | Weiss | |
| 7,372,007 | B1 * | 5/2008 | McClanahan et al. | 219/544 |
| 2008/0251511 | A1 | 10/2008 | Lee | |
| 2011/0204041 | A1 * | 8/2011 | Schlipf | 219/546 |
| 2012/0085749 | A1 | 4/2012 | Wheeler | |

FOREIGN PATENT DOCUMENTS

| | | | | |
|---|---|---|---|---|
| EP | 0086465 | A1 | 8/1983 | |
| EP | 743206 | A2 * | 11/1996 | B60H 1/22 |

* cited by examiner

MEDIUM VOLTAGE HEATING ELEMENT ASSEMBLY

TECHNICAL FIELD

The present disclosure is directed to electric heating element assemblies, heating systems that include electric heating element assemblies, and methods for assembling and operating electric heating element assemblies for use in medium voltage applications.

BACKGROUND

Electric heating element assemblies are used in a variety of applications, including heat exchangers, circulation systems, steam boilers, and immersion heaters. An electric heating element assembly generally includes a sheath, dielectric insulation within the sheath, an electrical resistance coil embedded in the dielectric insulation, and a conductor pin extending from the electrical resistance coil. Voltage is supplied to the conductor pin to generate heat in the electrical resistance coil. Many applications and systems that include electric heating element assemblies are rated for low voltage operations, where voltages below 600 volts can be considered low voltages. For example, many current heat exchangers operate with voltages in the range of 480 to 600 volts. More recently, various applications and systems for electric heating element assemblies have been proposed that operate above 600 volts. For example, heat exchangers that operate in the range of 600 to 38,000 volts have been proposed. These higher capacity heat exchangers are proposed as environmentally friendly alternatives to fuel-based heat exchangers. Voltages between 600 and 38,000 can be considered medium voltages. These higher voltages can place greater demands on the electric heating element assemblies.

For example, the higher voltage can be more difficult to dielectrically insulate, particularly at interfaces between the various components of the electric heating element assembly. The dielectric insulation within the sheath can include a single row of longitudinally-arranged dielectric cores, for example, which can be positioned end-to-end. Furthermore, a terminal bushing can be positioned against a dielectric core of the electric heating element assembly. At the interfaces between adjacent dielectric cores and/or between the terminal dielectric core and the bushing, higher voltages can be difficult to dielectrically insulate and, in some instances, dielectric breakdown and/or arcing can occur.

DESCRIPTION OF THE FIGURES

The various embodiments described herein may be better understood by considering the following description in conjunction with the accompanying figures, wherein.

DETAILED DESCRIPTION OF VARIOUS EMBODIMENTS

Figure 1:
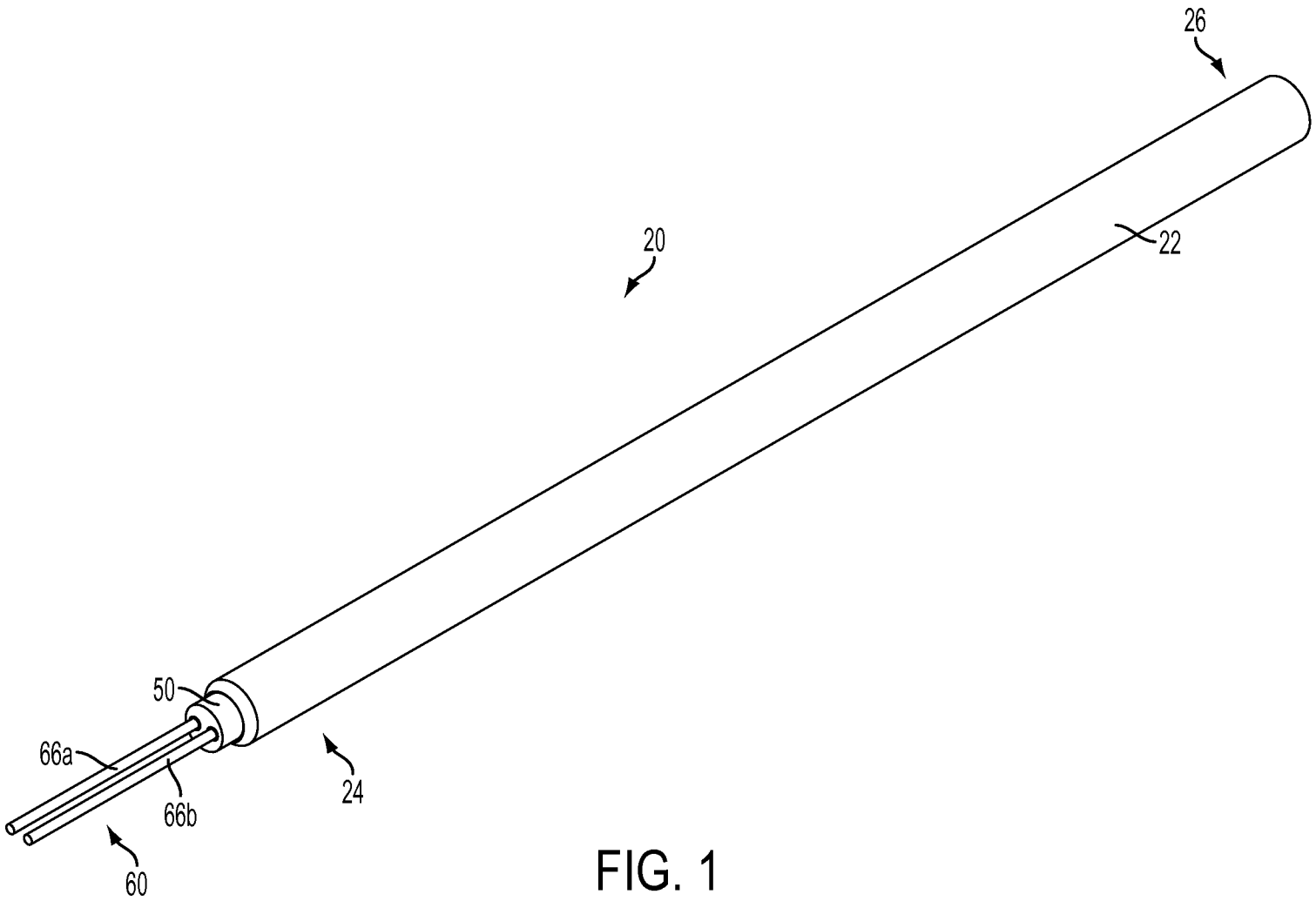
FIG. 1 is a perspective view of an electric heating element assembly according to various embodiments of the present disclosure.

In various embodiments, a medium-voltage heating element assembly can include a sheath, a dielectric core positioned within the sheath, and a resistive wire positioned within the dielectric core. The dielectric core can comprise an outer, annular core and an inner core, for example, with the inner core disposed within an axial central opening of the outer core, and with the inner and outer cores extending longitudinally generally along the length of the sheath. In certain embodiments, the inner core can include an interior passageway extending along the length thereof, and the resistive wire can be positioned in the interior passageway, for example. In various embodiments, the outer core can include a plurality of outer core segments, and the inner core can include a plurality of inner core segments. The inner core segments can be longitudinally offset relative to the outer core segments, for example. The staggered inner and outer core segments can prevent and/or reduce the likelihood of dielectric breakdown and/or arcing at the interfaces between adjacent core segments, for example.

In various embodiments, the medium-voltage heating element assembly can also include a groove-and-notch interface between the inner core and the outer core of the dielectric core. The groove-and-notch interface can prevent axial rotation of the inner core relative to the outer core, for example. Furthermore, the groove-and-notch interface can prevent axial rotation of an inner core segment relative to another inner core segment, for example, and/or of an outer core segment relative to another outer core segment, for example. In certain embodiments, axial rotation of the inner core relative to the outer core and/or axial rotation of adjacent segments of the inner and/or outer cores can cause a portion of the resistive wire to twist and/or stretch. Twisting and stretching of the resistive wire can damage the resistive wire and/or impair the heating function of the resistive wire. Accordingly, the groove-and-notch interface between the inner and outer core can prevent and/or reduce the likelihood of twisting along the length of the resistive wire, and thus, can maintain the integrity of the resistive wire.

In certain embodiments, the medium voltage heating element assembly can include a bushing, which can be positioned against the inner core of the dielectric core and at least partially within the central opening of the outer core of the dielectric core. In other words, the bushing can create a stepped interface, which can prevent and/or reduce the likelihood of dielectric breakdown and/or arcing at the interface between the dielectric core and the bushing. In certain embodiments, at least one conductor pin and/or an electrically insulative sleeve positioned around a conductor pin can extend through the bushing. A portion of the bushing can extend out of the sheath to prevent and/or reduce the likelihood of arcing between the conductor pin and the outer sheath, for example. The bushing can also prevent and/or reduce the likelihood of arcing between multiple conductor pins and/or the lead wires attached to the conductor pins, for example.

Referring now to FIGS. 1-7, an electric heating element assembly 20 can include an outer, cylindrical sheath 22 that defines an opening that houses the dielectric cores and resistive wire(s) and that extends from a first end 24 to a second end 26, as described further herein. In various embodiments, the outer sheath 22 can comprise a tube and/or sleeve, for example, which can at least partially encase and/or enclose the heat generating components of the electric heating element assembly 20. The outer sheath 22 can be a metallic tube, for example, such as a tube comprised of steel, stainless steel, copper, incoloy, inconel and/or hasteloy, for example.

Figure 2:
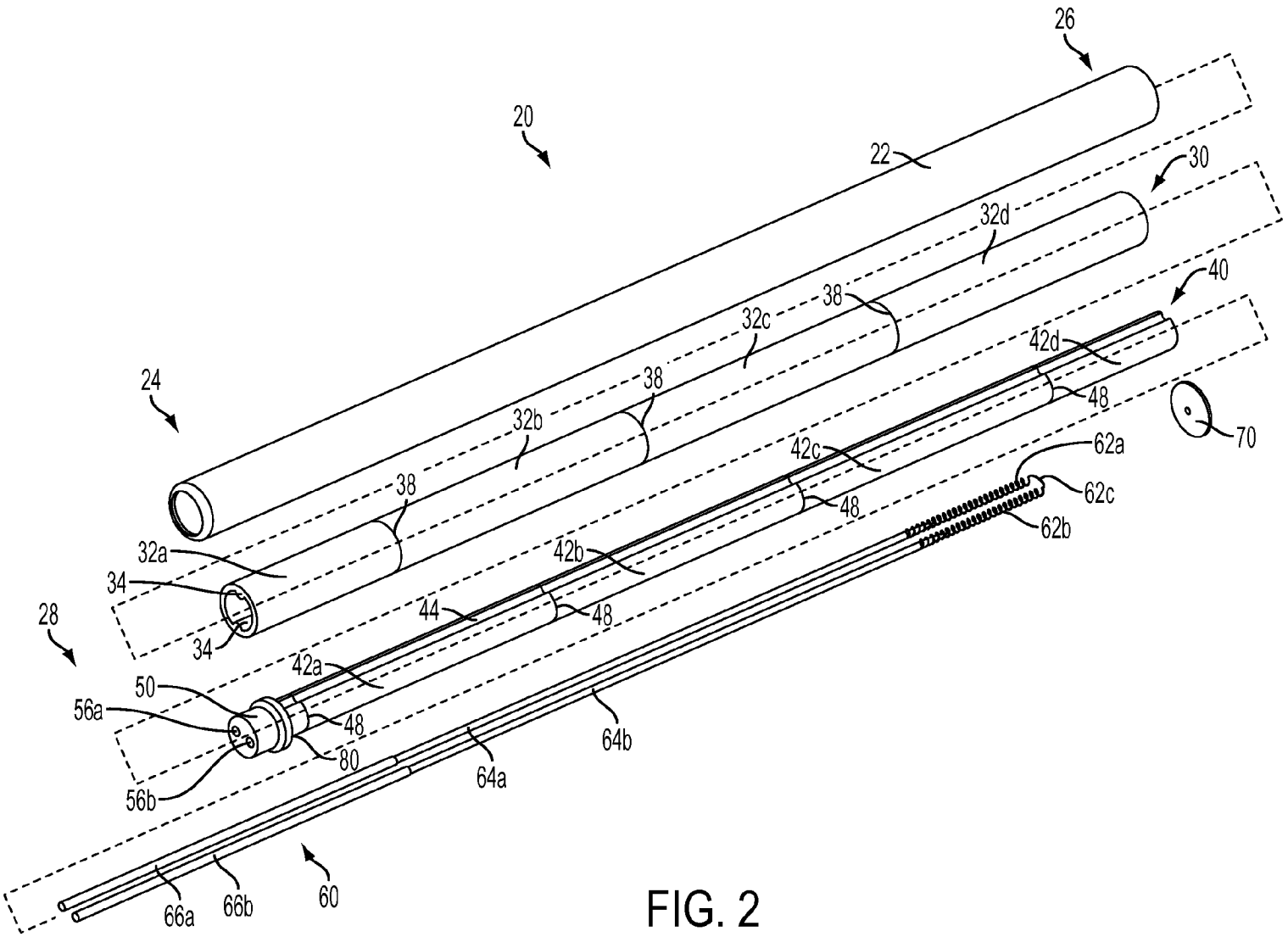
FIG. 2 is an exploded perspective view of the electric heating element assembly of FIG. 1 according to various embodiments of the present disclosure.
Figure 3A:
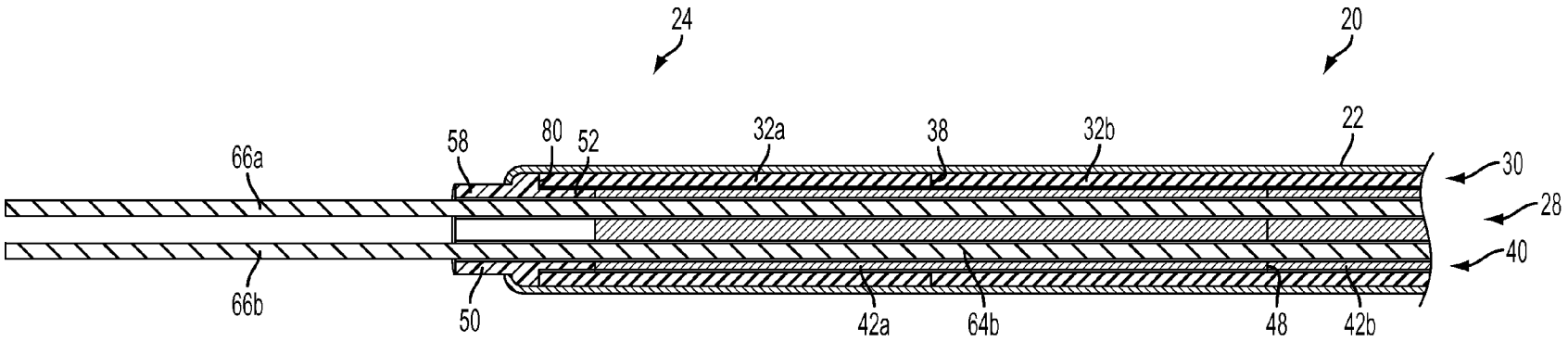
FIG. 3A is a cross-sectional plan view of the first end of the electric heating element assembly of FIG. 1 according to various embodiments of the present disclosure.
Figure 3B:
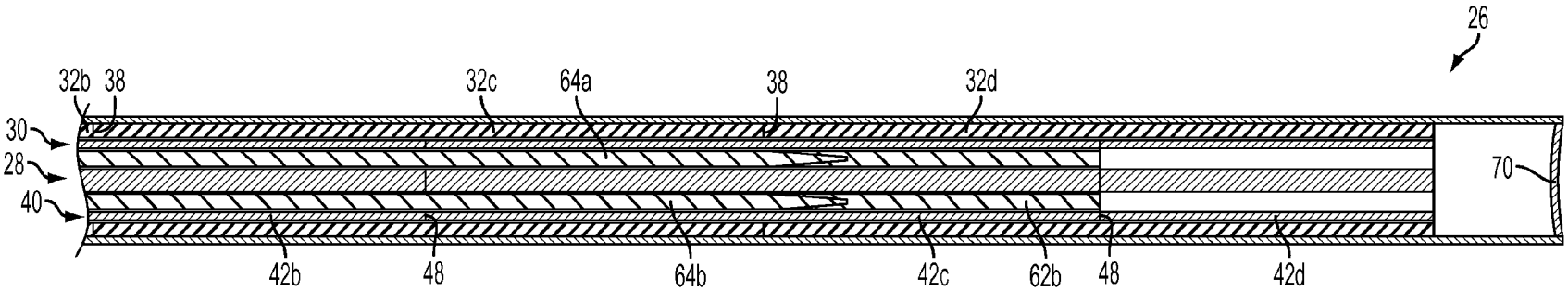
FIG. 3B is a cross-sectional plan view of the second end of the electric heating element assembly of FIG. 1 according to various embodiments of the present disclosure.
Figure 4:
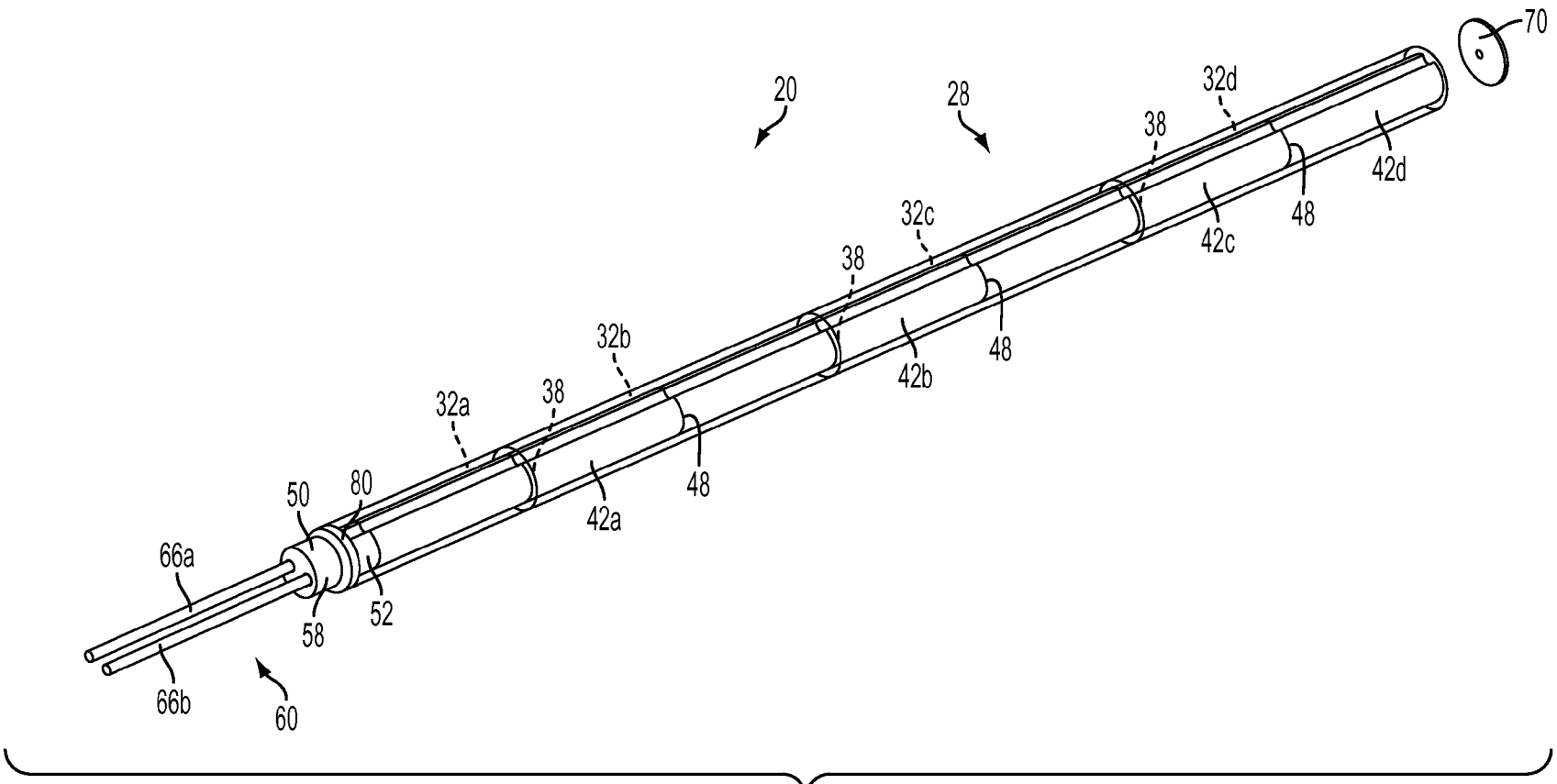
FIG. 4 is a perspective view of the electric heating element assembly of FIG. 1 having the outer sheath removed therefrom and the outer core segments shown in transparency to reveal the inner core segments positioned within the outer core segments according to various embodiments of the present disclosure.

Referring primarily to FIGS. 2-4, the electric heating element assembly 20 can include a dual core 28. In various embodiments, the dual core 28 can include generally cylindrical outer and inner cores 30, 40. The inner core 40 can be nested at least partially within a central opening of the outer core 30, for example. In certain embodiments, the outer core 30 can be positioned at least partially within the outer sheath 22, for example, and the inner core 40 can be positioned at least partially within the outer core 30, for example. In certain embodiments, the outer core 30 and/or the inner core 40 can be disposed entirely within the outer sheath 22. For example, the outer core 30 can extend through the outer sheath 22, and the inner core 40 can extend through the outer core 30, for example. The outer core 30 and/or the inner core 40 can be comprised of an electrically-insulating and/or dielectric material, for example. In certain embodiments, the outer core 30 and/or the inner core 40 can be comprised of boron nitride (BN), aluminum oxide (AlO), and/or magnesium oxide (MgO), for example. In certain embodiments, the outer core 30 and/or the inner core 40 can include a ceramic material. In various embodiments, the electric heating element assembly 20 can include a multi-layer core, which can include two or more at least partially nested cores, for example. For example, the electric heating element assembly 20 can include a multi-layer dielectric core that comprises three dielectric layers.

Referring still to FIGS. 2-4, in various embodiments, the outer core 30 and the inner core 40 can include multiple core segments. For example, the outer core 30 can include a plurality of outer core segments 32*a*, 32*b*, 32*c*, and/or 32*d*, and the inner core 40 can include a plurality of inner core segments 42*a*, 42*b*, 42*c*, and/or 42*d*. In various embodiments, the outer core segments 32*a*, 32*b*, 32*c*, and/or 32*d* can be axially aligned, and/or can be positioned end-to-end, for example, so that they collectively extend generally the length of the sheath 22. A boundary 38 can be positioned at the interface of adjacent outer core segments 32*a*, 32*b*, 32*c*, and/or 32*d*, for example. The boundary 38 can be a joint and/or seam between adjacent core segments, for example. In certain embodiments, a boundary 38 can be positioned between abutting ends of the outer core segments 32*a*, 32*b*, 32*c* and/or 32*d*, for example. Furthermore, in various embodiments, the inner core segments 42*a*, 42*b*, 42*c* and/or 42*d* can be axially aligned, and/or can be positioned end-to-end, for example, so that they collectively extend generally the length of the sheath 22. A boundary 48 can be positioned at the interface of adjacent inner core segments 42*a*, 42*b*, 42*c*, and/or 42*d*, for example. The boundary 48 can be a joint and/or seam between adjacent core segments, for example. In certain embodiments, a boundary 48 can be positioned between abutting ends of the inner core segments 42*a*, 42*b*, 42*c* and/or 42*d*, for example.

In various embodiments, the inner core segments 42*a*, 42*b*, 42*c*, and/or 42*d* can be longitudinally offset from the outer core segments 32*a*, 32*b*, 32*c*, and/or 32*d* so that the boundaries 48 of the inner core 40 are not aligned with the boundaries 38 of the outer core 30. For example, FIG. 4 depicts the dielectric core 28 of the heating element assembly 20 and shows the outer core segments 32*a*, 32*b*, 32*c*, and 32*d* in transparency such that the inner core segments 42*a*, 42*b*, 42*c*, and 42*d* positioned within the outer core 30 are revealed. As shown in FIG. 4, the inner core segments 42*a*, 42*b*, 42*c*, and 42*d* can be staggered relative to the outer core segments 32*a*, 32*b*, 32*c*, and 32*d*, for example. For example, the ends of the outer core segment 32*a* can be longitudinally offset from the ends of the inner core segment 42*a*. Furthermore, the ends of the outer core segment 32*b* can be longitudinally offset from the ends of the inner core segment 42*b*, the ends of outer core segment 32*c* can be longitudinally offset from the ends of the inner core segment 42*c*, and/or the ends of outer core segment 32*d* can be longitudinally offset from the ends of the inner core segment 42*d*, for example. In certain embodiments, the boundaries 38 between adjacent outer core segments 32*a*, 32*b*, 32*c*, and/or 32*d* can be staggered relative to the boundaries 48 between adjacent inner core segments 42*a*, 42*b*, 42*c*, and/or 42*d* so that the boundaries 38, 48 are not aligned. For example, a boundary 48 of the inner core 40 can be positioned between two boundaries 38 of the outer core 30. In various embodiments, a boundary 48 of the inner core 40 can be positioned at the midpoint or approximately the midpoint between two boundaries 38 of the outer core 30. In other embodiments, the boundary 48 of the inner core 40 can be non-symmetrically offset between two boundaries 38 of the outer core 30.

In an electric heating element assembly comprising a single dielectric core, dielectric breakdown and/or arcing is more likely to occur at a fault and/or joint in the dielectric core. For example, the boundary between adjacent end-to-end components of the dielectric core can result in a potentially compromised region, and current may attempt to flow through such a region. Accordingly, a dual core 28 having staggered boundaries 38, 48 between the outer core 30 and the inner core 40, respectively, can offset the potentially compromised regions in the outer core 30 from the potentially compromised regions in the inner core 40. As a result, current may be less inclined to attempt to flow through the indirect, stepped path between the inner core 40 and the outer core 30, and thus, the stepped interface formed by the staggered boundaries 38, 48 can prevent and/or reduce the likelihood of dielectric breakdown and/or arc. Furthermore, in various embodiments, the electric heating element assembly 20 can include additional powdered and/or particulate dielectric material within the outer sheath 22. Such dielectric material can settle at the boundaries 38, 48 between various elements of the dual core 28, in faults, voids, and/or cracks of the various dual core 28 elements, and/or between the dual core 28 and various other components of the electric heating element assembly 20, such as, for example, the outer sheath 22, a termination bushing 50, and/or a termination disk 70.

In various embodiments, various segments 42*a*, 42*b*, 42*c*, 42*d* of the inner core 40 and various segments 32*a*, 32*b*, 32*c*, 32*d* of the outer core 30 can comprise various lengths. In certain embodiments, at least one of the inner core segments 42*a*, 42*b*, 42*c*, and/or 42*d* can define a length shorter than the other inner core segments 42*a*, 42*b*, 42*c*, and/or 42*d*, and at least one of the outer core segments 32*a*, 32*b*, 32*c*, and/or 32*d* can define a length shorter than the other outer core segments 32*a*, 32*b*, 32*c*, and/or 32*d*. In other words, various segments of the inner core 40 and/or the outer core 30 may comprise different lengths. In certain embodiments, the differing lengths can facilitate the longitudinal offset and/or staggering of various segments 42*a*, 42*b*, 42*c*, and/or 42*d* of the inner core 40 relative to the various segments 32*a*, 32*b*, 32*c*, and/or 32*d* of the outer core 30, for example.

For example, referring still to FIGS. 2-4, the first outer core segment 32*a* can have a shorter length than the other outer core segments 32*b*, 32*c*, and/or 32*d*, and the final inner core segment 42*d* can have a shorter length than the other inner core segments 42*a*, 42*b*, and/or 42*c*, for example. In various embodiments, the length of the first outer core segment 32*a* can be approximately half the length of the other outer core segments 32*b*, 32*c*, and/or 32*d*, for example, and the length of the final inner core segment 42*d* can be approximately half the length of the other inner core segments 42*a*, 42*b*, and/or 42*c*, for example. In such embodiments, the interface between adjacent inner core segments 42*a*, 42*b*, 42*c*, and/or 42*d* can be halfway between the interfaces between the nearest adjacent outer core segments 32*a*, 32*b*, 32*c*, and/or 32*d*, for example. Furthermore, the various segments of the inner core 40 and the outer core 30 can be rearranged and/or reordered to create staggered interfaces, for example. Furthermore, the dual core 28 can include additional and/or few segments. For example, the outer core 30 can include more than and/or less than four core segments, and/or the inner core 40 can include more than and/or less than four core segments, for example.

Figure 5:
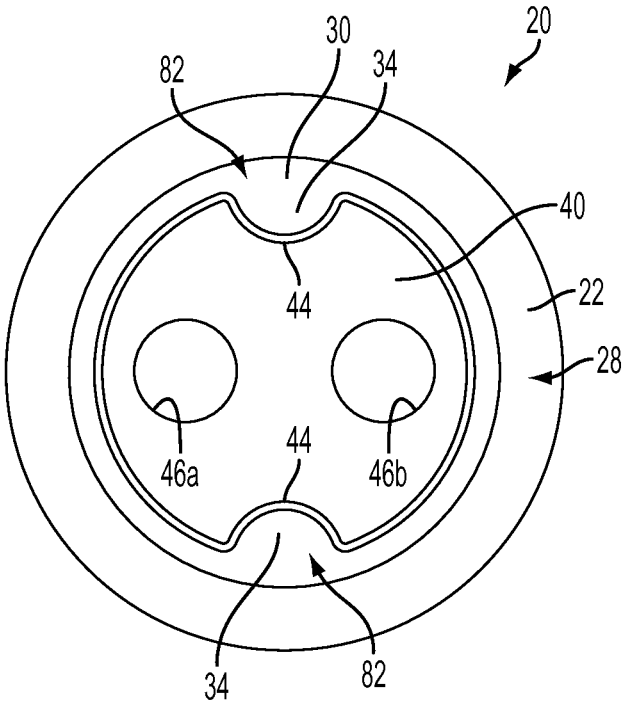
FIG. 5 is an elevational view of the electric heating element assembly of FIG. 1 with the bushing, the resistive coils, and the conductor pins removed therefrom according to various embodiments of the present disclosure.

In various embodiments, the inner core 40 and/or the various segments 42*a*, 42*b*, 42*c*, and/or 42*d* thereof can include one or more interior passageways 46*a*, 46*b*. Referring primarily to FIG. 5, the interior passageways 46*a*, 46*b* can extend along the length of the inner core 40, for example, and can be configured to receive at least a portion of a conductive assembly 60. The conductive assembly 60 can include one or more coiled resistive wires 62*a*, 62*b* and/or one or more conductor pins 64*a*, 64*b*, for example. At least a portion of the resistive wires 62*a*, 62*b* can be coiled, for example, and can generate heat as current flows through the coil, for example. In various embodiments, the resistive coils 62*a* and 62*b*, respectively, can extend through one of the interior passageways 46*a*, 46*b*. Also, the conductor pins 64*a* and 64*b*, respectively, can extend through one of the interior passageways 46*a*, 46*b*. In various embodiments, the axis of the first coil 62*a* and the axis of the second coil 62*b* can be substantially parallel. The first coil 62*a* can extend through the first interior passageway 46*a*, and the second coil 62*b* can extend through the second interior passageway 46*b*, for example. In various embodiments, the first coil 62*a* can be coupled to the second coil 62*b*. For example, a u-shaped wire 62*c* (FIG. 2) can connect the first coil 62*a* to the second coil 62*b*. The u-shaped wire 62*c* can extend from the first coil 62*a* positioned in the first interior passageway 46*a* to the second coil 62*b* positioned in the second interior passageway 46*b*, for example. In certain embodiments, referring primarily to FIG. 3B, the u-shaped wire 62*c* can be positioned at the boundary 48 between the third inner core segment 42*c* and the final inner core segment 42*d*, for example. In various embodiments, a conductive wire, coil, and/or pin can extend between the first coil 62*a* and the second coil 62*b*.

In various embodiments, the electric heating element assembly 20 (FIGS. 1-7) can include a single conductive assembly 60 that comprises the pair of resistive coils 62*a* and 62*b* connected by the conductive wire 62*c*. The inner core 40 of the electric heating element assembly 20 can include a single pair of interior passageways 46*a*, 46*b*, for example, wherein each interior passageway 46*a*, 46*b* can be configured to receive a single resistive coil 62*a*, 62*b* of the conductive assembly 60. In various embodiments, an electric heating element assembly can include one or more conductive assemblies, similar to the conductive assembly 60, for example. For example, referring now to FIG. 10, an electric heating element assembly 320, similar to the electric heating element assembly 20, for example, can include a plurality of conductive assemblies (not shown). In certain embodiments, each conductive assembly of the electric heating element assembly 320 can include a pair of resistive wires connected by a conductive wire, for example. Similar to the electric heating element assembly 20, for example, the electric heating element assembly 320 can include an outer sheath 322 and a dual core 328 positioned in the outer sheath 322. The dual core 328 can include an outer core 330 and an inner core 340, for example, which can have staggered core segments, similar to dielectric core 28, for example. Interior passageways 346*a*, 346*b*, 346*c*, and/or 346*d* can extend longitudinally through the inner core 340, for example, and can be configured to receive at least a portion of the conductive assemblies, for example. In various embodiments, each interior passageway 346*a*, 346*b*, 346*c*, and/or 346*d* of the inner core 340 can be configured to receive at least a portion of a resistive coil of a conductive assembly. For example, first and second resistive coils of a first conductive assembly can be positioned in the passageways 346*a* and 346*b*, respectively, and first and second resistive coils of a second conductive assembly can be positioned in the passageways 346*c* and 346*d*, respectively.

In various embodiments, a plurality of conductive assemblies can extend through the inner core 340. In certain embodiments, a three-wire conductive assembly can be positioned within the inner core 340. In various embodiments, for three-phrase power applications, for example, three conductive wires can be positioned within the inner core 340. For example, three interior passageways can extend through the inner core 340 to receive the resistive coils of the three-wire conductive assembly. In other embodiments, additional and/or fewer conductive assemblies, and/or conductive assemblies with a different number of resistive coils, can be positioned within the inner core 340, and/or additional and/or fewer through passageways can extend through the inner core 340, for example.

Figure 10:
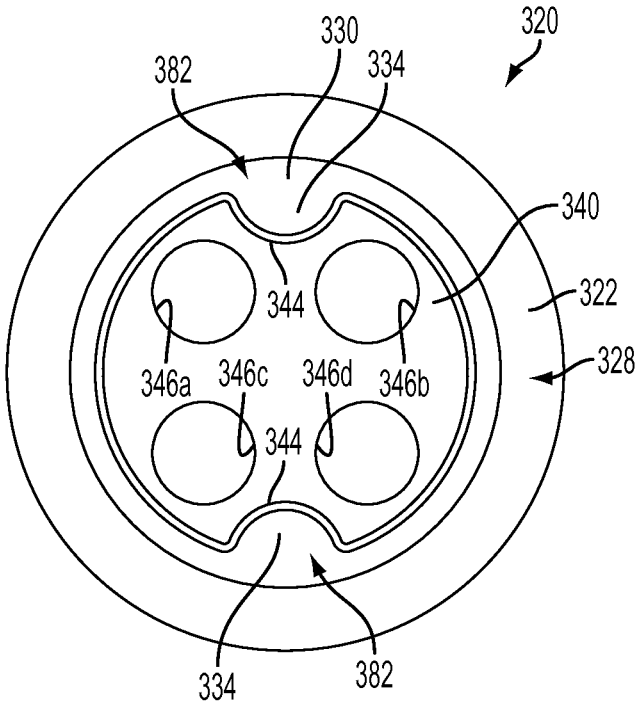
FIG. 10 is an elevational view of an electric heating element assembly with the bushing, the resistive coils and the conductor pins removed therefrom according to various embodiments of the present disclosure.

Referring still to FIG. 10, in various embodiments, the dual core 328 can also include at least one groove-and-notch interface 382 between the outer core 330 and the inner core 340. The groove-and-notch interface 382 can be similar to groove-and-notch interfaces 82 and/or 182, for example, which are further described herein. For example, each groove-and-notch interface 382 can include a groove 344 in the inner core 340 and a notch 334 in the outer core 330, wherein the notch 334 can fit within the groove 344, for example. Furthermore, the electric heating element assembly 320 can include a terminal bushing (not shown), similar to the terminal bushing 50, for example, which is further described herein. The terminal bushing of the electric heating element assembly 320 can include a plurality of interior passageways that correspond to the interior passageways 346*a*, 346*b*, 346*c*, and/or

346*d* of the inner core 340, for example. A conductor pin extending from each resistive coil of the conductive assemblies positioned through the dual core of the 328 can extend through the interior passageways of the terminal bushing, for example.

In certain embodiments, a conductive assembly can extend through both ends of an electric heating element assembly. For example, a conductive assembly may not include a u-shaped portion, e.g., a connective wire, coil, and/or pin, within the outer sheath of the electric heating element assembly. For example, referring now to FIG. 9, a conductive assembly 260 can extend through both ends of an electric heating element assembly 220. Similar to the electric heating element assembly 20, for example, the electric heating element assembly 220 can include an outer sheath 222 and a dual core positioned in the outer sheath 222. The outer sheath 222 can include a first end 224 and a second end 226, for example. Furthermore, the dual core can include an outer core and an inner core, for example, which can have staggered core segments, similar to dielectric core 28, for example. In various embodiments, the conductive assembly 260 can extend through the first end 224 of the outer sheath 222 and through the second end 226 of the outer sheath 222. The conductive assembly 260 can include a resistive coil having a first end and a second end, for example. The conductive assembly 260 can also include a first conductor pin and/or leadwire extending from the first end of the resistive coil and through the first end 224 of the outer sheath 222, for example, and a second conductor pin and/or leadwire extending from the second end of the resistive coil and through the second end 226 of the outer sheath 222, for example. A first electrically insulative sleeve 266*a* can be positioned around the first conductor pin, and a second electrically insulative sleeve 266*b* can be positioned around the second conductor pin, for example.

Figure 9:
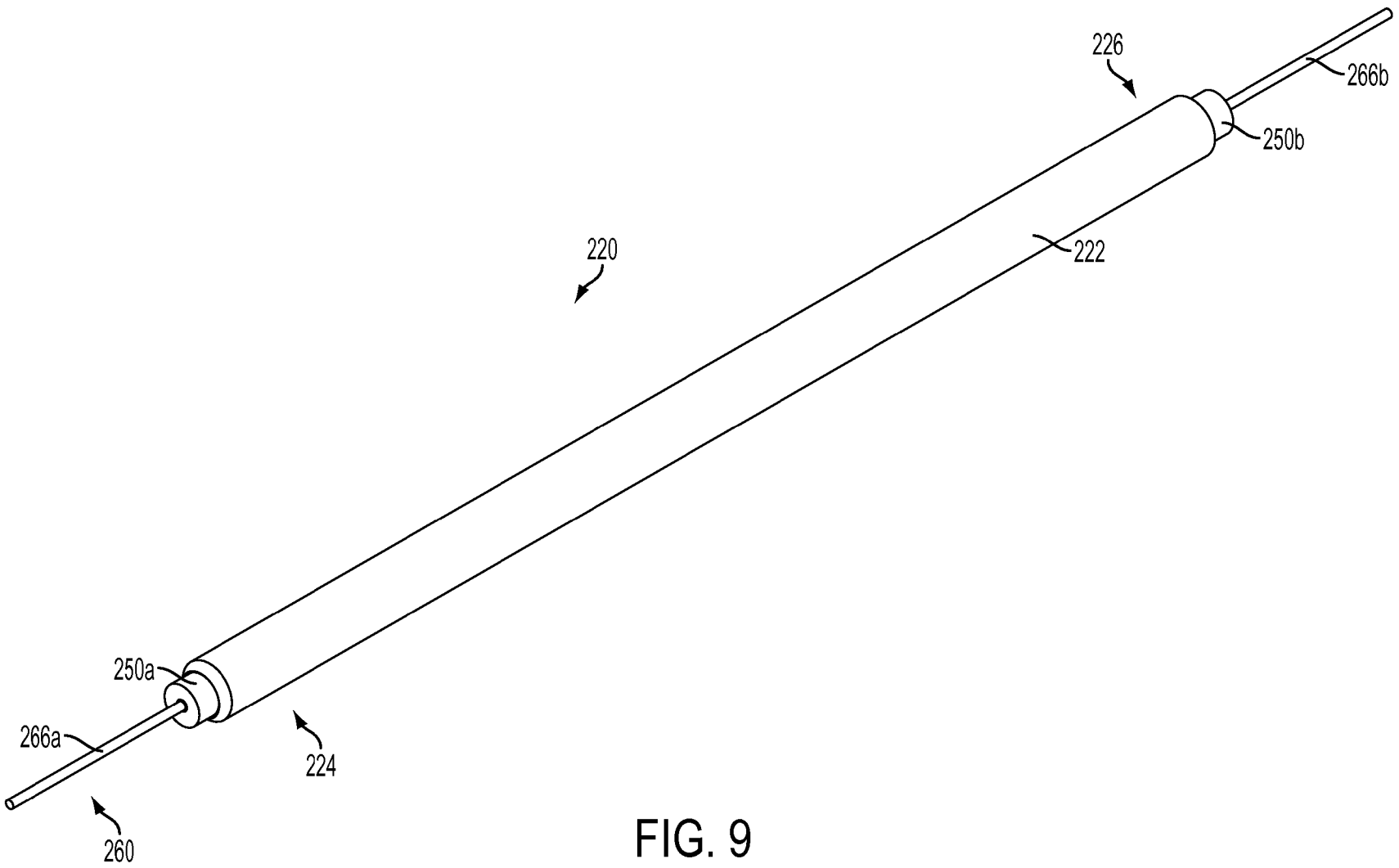
FIG. 9 is a perspective view of an electric heating element assembly according to various embodiments of the present disclosure.

Referring still to FIG. 9, the electric heating element assembly 220 can include a first terminal bushing 250*a* at the first end 224 of the outer sheath 222, and a second terminal bushing 250*b* at the second end 226 of the outer sheath 222. The terminal bushings 250*a*, 250*b* of the electric heating element assembly 220 can include an interior passageway that corresponds to the interior passageway of the inner core, for example. In various embodiments, the first conductor pin and/or leadwire extending from the first end of the resistive coil can extend through the first terminal bushing 250*a*, for example, and the second conductor pin and/or leadwire extending from the second end of the resistive coil can extend through the second terminal bushing 250*b*, for example. In various embodiments, a plurality of conductive assemblies 260 can extend through the inner core. In certain embodiments, for three-phrase power applications, for example, three conductive assemblies 260 can extend through the first end 224 of the outer sheath 222 and through the second end 226 of the outer sheath 222. In other embodiments, additional and/or few conductive assemblies can extend through the outer sheath 222 of the electric heating element assembly.

Referring again to FIGS. 1-7, a leadwire (not shown) and/or a conductor pin 64*a*, 64*b* can extend from each resistive coil 62*a*, 62*b* of the conductive assembly 60 through the electric heating element assembly 20. The leadwire and/or the conductor pin 64*a*, 64*b* can conduct current from a power source to the resistive coil 62*a*, 62*b* coupled thereto. In various embodiment, where the resistive coils 62*a* and 62*b* are coupled together, for example by a u-shaped portion, one of the leadwires and/or the conductor pins 62*a*, 62*b* can provide a supply path, and the other of the leadwires and/or the conductor pins 62*a*, 62*b* can provide a return path, for example. In certain embodiments, a lead wire can be coupled to each conductor pin 64*a*, 64*b*. The lead wires can extend from the conductor pin 64*a*, 64*b* to a busbar or a distribution block, for example. In various embodiments, the electrically insulative sleeve 66*a*, 66*b* can be positioned around the lead wire-conductor pin connection. The electrically insulative sleeve 66*a*, 66*b* can prevent and/or further reduce the likelihood of arcing between the conductor pins 64*a*, 64*b* and/or between a conductor pin 64*a*, 64*b* and the outer sheath 22, for example.

In various embodiments, referring primarily to FIG. 5, the dual core 28 can include a groove-and-notch interface 82 between the outer core 30 and the inner core 40. For example, the outer core 30 can include one or more inwardly-extending notches 34, and the inner core 40 can include a corresponding number of grooves 44 for receiving the notches 34. In various embodiments, the notches 34 can extend longitudinally along at least a portion of the length of the outer core 30. In certain embodiments, the grooves 44 can extend longitudinally along at least a portion of the length of the inner core 40. The example of FIG. 5 shows two such groove and notch interfaces 82, in this case, on diametrically opposed sides of the inner core 40 The groove-and-notch interfaces 82 can extend along the length of the dual core 28 and/or can extend along portions of the length of the dual core 28, for example.

In various embodiments, the groove-and-notch interface 82 can limit and/or substantially prevent axial rotation of at least a portion of the inner core 40 relative to at least a portion of the outer core 30, for example. In certain embodiments, the groove-and-notch interface 82 can prevent axial rotation of the entire inner core 40 relative to entire outer core 30. Furthermore, the groove-and-notch interface 82 can prevent axial rotation of an inner core segment 32*a*, 32*b*, 32*c*, and/or 32*d* relative to another inner core segment 32*a*, 32*b*, 32*c*, and/or 32*d*. For example, the groove-and-notch interface 82 can prevent axial rotation of the inner core segment 32*a* relative to the inner core segment 32*b*, axial rotation of the inner core segment 32*b* relative to the inner core segments 32*a* and/or 32*c*, axial rotation of the inner core segment 32*c* relative to the inner core segments 32*b* and/or 32*d*, and/or axial rotation of the inner core segment 32*d* relative to the inner core segment 32*c*, for example. In various embodiments, each inner core segment 32*a*, 32*b*, 32*c*, and/or 32*d* can be axially restrained relative to each other inner core segment 32*a*, 32*b*, 32*c* and/or 32*d*, for example.

Furthermore, in various embodiments, the groove-and-notch interface 82 can prevent axial rotation of an outer core segment 42*a*, 42*b*, 42*c*, and/or 42*d* relative to another outer core segment 42*a*, 42*b*, 42*c*, and/or 42*d*. For example, the groove-and-notch interface 82 can prevent axial rotation of the outer core segment 42*a* relative to the outer core segment 42*b*, axial rotation of the outer core segment 42*b* relative to the outer core segments 42*a* and/or 42*c*, axial rotation of the outer core segment 42*c* relative to the outer core segments 42*b* and/or 42*d*, and/or axial rotation of the outer core segment 42*d* relative to the outer core segment 42*c*, for example. In various embodiments, each outer core segment 42*a*, 42*b*, 42*c*, and/or 42*d* can be axially restrained relative to each other outer core segment 42*a*, 42*b*, 42*c* and/or 42*d*, for example.

Twisting of the resistive coils 62*a*, 62*b* can damage the resistive coils 62*a*, 62*b* and/or impair the heating function of the resistive coils 62*a*, 62*b*, for example. In various embodiments, the groove-and-notch interface 82 between the inner core 40 and outer core 30 can prevent and/or reduce the likelihood of twisting along the length of the resistive coils 62*a*, 62*b*, and thus, can maintain the integrity of the resistive coils 62*a*, 62*b*. Furthermore, the groove-and-notch interface 82 can maintain axial alignment of the conductive assembly 60, including the conductor pins 64*a*, 64*b* thereof, and thus, prevent torsion of the conductive assembly 60 along the length of the heating element assembly 20.

Figure 8:
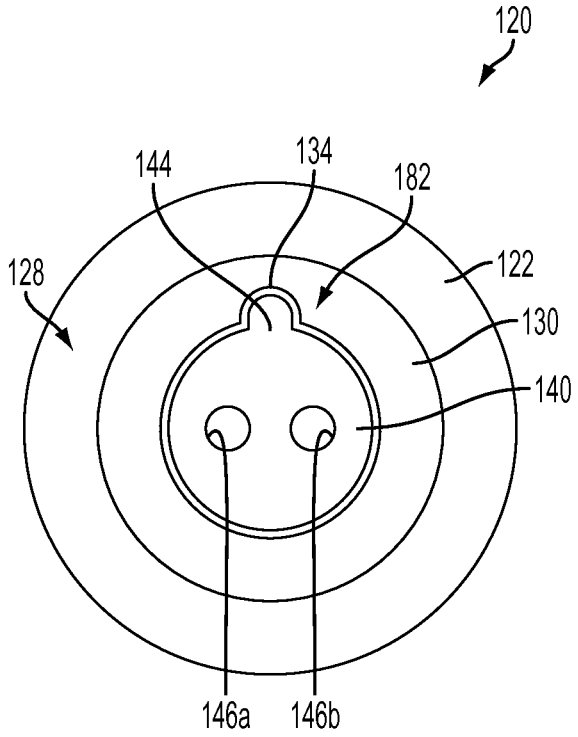
FIG. 8 is an elevational view of an electric heating element assembly with the bushing, the resistive coils and the conductor pins removed therefrom according to various embodiments of the present disclosure.

Referring now to FIG. 8, an electric heating element assembly 120, similar to the electric heating element assembly 20, for example, can include an outer sheath 122 and a dual core 128 position in the outer sheath 122. The dual core 128 can include an outer core 130 and an inner core 140. Interior passageways 146*a*, 146*b* can extend through the inner core 140, for example, and can be configured to receive a conductive assembly, for example. In various embodiments, the dual core 128 can include a groove-and-notch interface 182 between the outer core 130 and the inner core 140. For example, the outer core 130 can include a groove 134, and the inner core 140 can include an inwardly and/or outwardly extending notch 144. The groove 134 can be configured to receive the notch 144, for example. In various embodiments, the notch 144 can extend longitudinally along at least a portion of the length of the inner core 140. In certain embodiments, the groove 134 can extend longitudinally along at least a portion of the length of the outer core 130. In various embodiments, the dual core 128 can include multiple groove-and-notch interfaces 182. For example, the dual core 128 can include a plurality of groove-and-notch interfaces 182 around the outer perimeter of the inner core 140 and the inner perimeter of the outer core 130. The groove-and-notch interfaces 182 can extend along the length of the dual core 128 and/or extend along portions of the length of the dual core 128, for example. Similar to the groove-and-notch interface 82, the groove- and notch interface 182 can prevent axial rotation of the inner core 140 relative to the outer core 130, for example. Furthermore, the groove-and-notch interface 182 can prevent axial rotation of a segment of the inner core 140 relative to other segments of the inner core 140, for example, and/or a segment of the outer core 130 relative to other segments of the outer core 130, for example.

Figure 6:
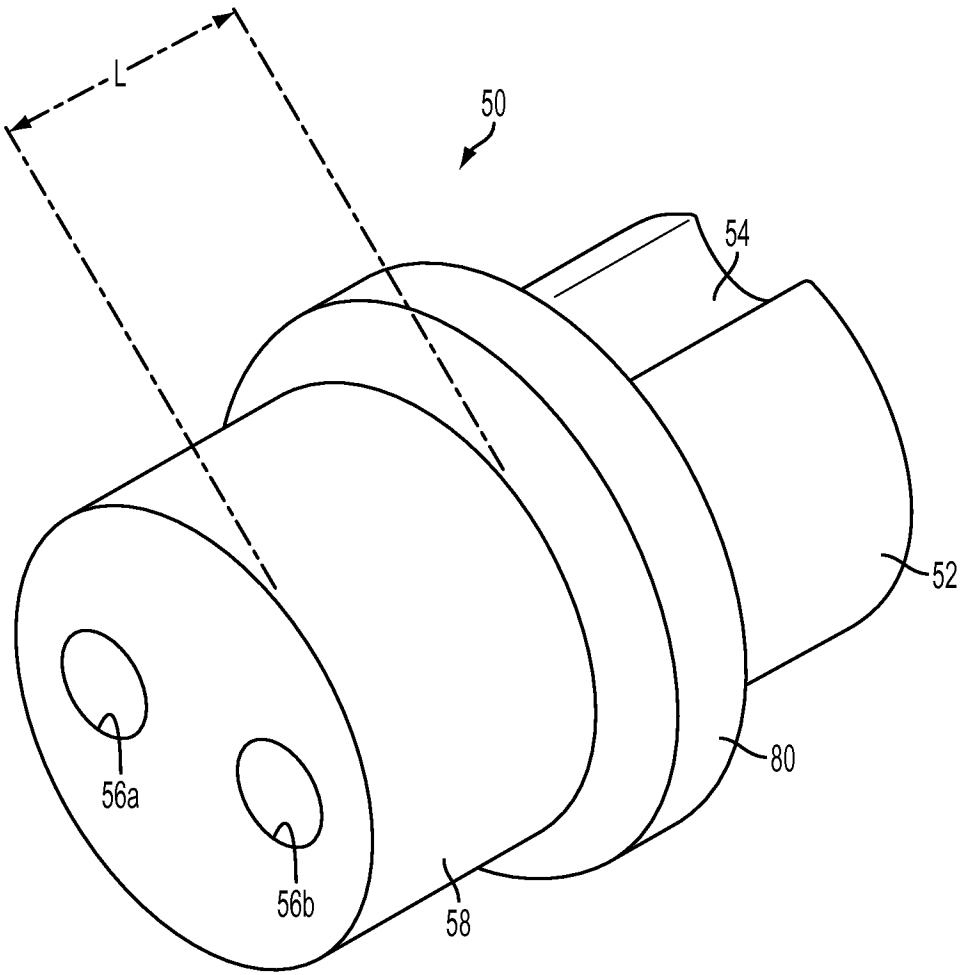
FIG. 6 is a perspective view of the bushing of the electric heating element assembly of FIG. 1 according to various embodiments of the present disclosure.
Figure 7:
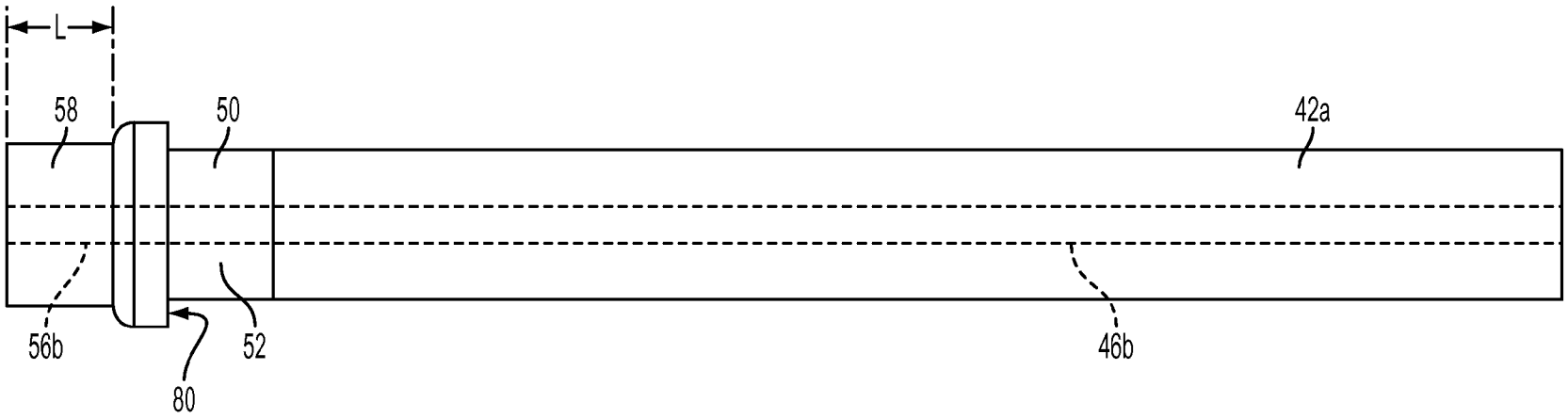
FIG. 7 is an elevational view of the bushing and first inner core segment of the electric heating element assembly of FIG. 1 according to various embodiments of the present disclosure.

Referring again to FIGS. 1-7, the electric heating element assembly 20 can include a bushing 50 at and/or near the first end 24 of the sheath 22. The conductor pins 64*a*, 64*b* can extend through interior passageways 56*a*, 56*b* (FIG. 6) in the bushing 50, for example. In various embodiments, the bushing 50 can prevent and/or reduce the likelihood of arcing between multiple leadwires and/or conductor pins 64*a*, 64*b* and the sheath 22. Referring primarily to FIGS. 6 and 7, the bushing 50 can include a first end portion 52, a second end portion 58, and a sealing surface 80 between the first and second end portions 52, 58, for example. The first end portion 52 can be positioned within the outer sheath 22 and preferably within the central opening of the outer core 30. In various embodiments, the first end portion 52 can abut the first inner core segment 42*a*, such that the first end portion 52 is flush with an end of the first inner core segment 42*a*, for example. Furthermore, in various embodiments, the first outer core segment 32*a* (FIG. 4) can be positioned around the first end portion 52 of the bushing 50. In various embodiments, the sealing surface 80 of the bushing 50 can extend outward radially. The sealing surface 80 can abut the first outer core segment 32*a*, for example, such that the sealing surface 80 is flush with an end of the first outer core segment 32*a*, for example.

In an electric heating element assembly comprising a conventional bushing, dielectric breakdown and/or arcing can be likely to occur at the joint and/or interface between the dielectric core and the bushing. For example, a non-stepped interface between the dielectric core and bushing can result in a potentially comprised region, and current may attempt to flow through such a region. Referring primarily to FIG. 3A, a stepped interface exists between the bushing 50 and dielectric core 28. Accordingly, the stepped interface can offset the potentially compromised region between the first end 52 of the bushing 50 and first inner core segment 42*a* of the inner core 40 from the potentially compromised region between the sealing surface 80 of the bushing 50 and the first outer core segment 32*a* of the outer core 30, for example. As a result, current may be less inclined to attempt to flow through the indirect, stepped path, and thus, the stepped interface can prevent and/or reduce the likelihood of dielectric breakdown and/or arc between the dielectric core 28 and the bushing 50.

In various embodiments, the second end portion 58 of the bushing can extend out of the outer sheath 22. For example, referring primarily to FIGS. 3A, 6, and 7, the second end portion 58 can extend from the outer sheath a distance L (FIGS. 6 and 7), for example. The distance L can be selected such that arc between the conductor pin 64*a*, 64*b* and the outer sheath 22 is eliminated and/or reduced, for example. In certain embodiments, the distance L can be approximately 0.25 inches to approximately 1.00 inches for example.

In certain embodiments, the material of the bushing can be a fluoroelastomer, ceramic, polytetrafluoroethylene (PTFE), and/or mica, for example. In various embodiments, the electric heating element assembly 20 can include a disk 70 at and/or near the second end 26 of the outer sheath 22. For example, the disk 70 can seal the second end 26 of the outer sheath 22. In various embodiments, the disk 70 can be welded or brazed to the outer sheath 22, for example. In certain non-limiting embodiments, dielectric material can be positioned between the disk 70 and the dielectric core 28 within the outer sheath 22, for example. In various embodiments, the disk can comprise steel, stainless steel, copper, incoloy, inconel and/or hasteloy, for example. In certain embodiments, the material of the disk 70 can match the material of sheath 22, for example.

In various embodiments, the electric heating element assembly 20 can be assembled from the various components described herein. For example, the segments 42*a*, 42*b*, 42*c*, and/or 42*d* of the inner core 40 can be axially arranged end-to-end, and the segments 32*a*, 32*b*, 32*c*, and/or 32*d* of the outer core 30 can be axially arranged end-to-end. The outer core 30 can be positioned around the inner core 40, for example. In certain embodiments, the inner core segments 42*a*, 42*b*, 42*b*, and/or 42*d* can be positioned within the unassembled, partially-assembled and/or assembled outer core 30. The notch- and groove interface(s) 82 can facilitate positioning of the various components of the core segments, and can prevent axial rotation of the various core segments. Furthermore, the resistive coils 62*a*, 62*b* and/or the conductive pins 64*a*, 64*b* of the conductive assembly 60 can be thread through the interior passageways 46*a*, 46*b* in the inner core 40, for example. The resistive coils 62*a*, 62*b* and/or the conductive pins 64*a*, 64*b* can be positioned within the unassembled, partially-assembled, and/or assembled dielectric core 28, for example. In various embodiments, the bushing 50 can be secured to the dual core 28. In certain embodiments, the dual core 28 and bushing 50 can be positioned in the outer sheath 22 of the electric heating element assembly 20, for example. The disk 70 can be welded or brazed to the outer sheath 22 at the second end 26 opposite to the bushing 50, for example. In certain embodiments, the entire assembly can be forged, rolled, and/or swaged, for example, to further compact the dual core assembly 28 and/or the various materials positioned within the outer sheath 22. The compaction can also provide a tight seal between the inner and outer core segments to the bushing 50 and the sheath 22.

In various embodiments, the electric heating element assembly 20 described herein can dielectrically withstand low, medium and/or high voltages. In certain embodiments, the electric heating element assembly 20 can operate above 600 volts, for example. Industry standard electrical safety tests can be performed to ensure electric heating element product design is adequate for fluctuations in voltage and dielectric breakdown at high temperatures. A dielectric withstand voltage test is often performed at 2.25 times the rated voltage plus 2000 volts for medium voltage industrial components. Such tests can be used in testing the electric heating element assemblies described herein, for example. In certain embodiments, the electric heating element assemblies described herein can dielectrically withstand voltages in excess of 11,360 volts and may dielectrically breakdown between 14,000 volts and 16,000 volts.

The electric heating element assemblies described herein can be used in a wide variety of applications and/or systems. For example, the electric heating element assemblies can be used in heat exchangers, circulation systems, steam boilers, and immersion heaters. Because the electric heating element assemblies described herein can tolerate higher voltages, the applications and/or systems utilizing these electric heating element assemblies can require fewer heating element assemblies, and/or fewer resistive coils and/or circuits, for example, and can eliminate and/or reduce the need to step down voltage for the heating systems, for example.

It is to be understood that various descriptions of the disclosed embodiments have been simplified to illustrate only those features, aspects, characteristics, and the like that are relevant to a clear understanding of the disclosed embodiments, while eliminating, for purposes of clarity, other features, aspects, characteristics, and the like. Persons having ordinary skill in the art, upon considering the present description of the disclosed embodiments, will recognize that other features, aspects, characteristics, and the like may be desirable in a particular implementation or application of the disclosed embodiments. However, because such other features, aspects, characteristics, and the like may be readily ascertained and implemented by persons having ordinary skill in the art upon considering the present description of the disclosed embodiments, and are, therefore, not necessary for a complete understanding of the disclosed embodiments, a description of such features, aspects, characteristics, and the like is not provided herein. As such, it is to be understood that the description set forth herein is merely exemplary and illustrative of the disclosed embodiments and is not intended to limit the scope of the invention as defined solely by the claims.

In the present disclosure, other than where otherwise indicated, all numbers expressing quantities or characteristics are to be understood as being prefaced and modified in all instances by the term "about." Accordingly, unless indicated to the contrary, any numerical parameters set forth herein may vary depending on the desired properties one seeks to obtain in the embodiments according to the present disclosure. For example, the term "about" can refer to an acceptable degree of error for the quantity measured, given the nature or precision of the measurement. Typical exemplary degrees of error may be within 20%, within 10%, or within 5% of a given value or range of values. At the very least, and not as an attempt to limit the application of the doctrine of equivalents to the scope of the claims, each numerical parameter described in the present description should at least be construed in light of the number of reported significant digits and by applying ordinary rounding techniques.

Also, any numerical range recited herein is intended to include all sub-ranges subsumed therein. For example, a range of "1 to 10" is intended to include all sub-ranges between (and including) the recited minimum value of 1 and the recited maximum value of 10, that is, having a minimum value equal to or greater than 1 and a maximum value equal to or less than 10. Any maximum numerical limitation recited herein is intended to include all lower numerical limitations subsumed therein, and any minimum numerical limitation recited herein is intended to include all higher numerical limitations subsumed therein. Accordingly, Applicants reserve the right to amend the present disclosure, including the claims, to expressly recite any sub-range subsumed within the ranges expressly recited herein. All such ranges are intended to be inherently disclosed herein such that amending to expressly recite any such sub-ranges would comply with the requirements of 35 U.S.C. §112, first paragraph, and 35 U.S.C. §132(a).

The grammatical articles "one", "a", "an", and "the", as used herein, are intended to include "at least one" or "one or more", unless otherwise indicated. Thus, the articles are used herein to refer to one or more than one (i.e., to at least one) of the grammatical objects of the article. By way of example, "a component" means one or more components, and thus, possibly, more than one component is contemplated and may be employed or used in an implementation of the described embodiments.

Any patent, publication, or other disclosure material that is said to be incorporated by reference herein, is incorporated herein in its entirety unless otherwise indicated, but only to the extent that the incorporated material does not conflict with existing definitions, statements, or other disclosure material expressly set forth in this disclosure. As such, and to the extent necessary, the express disclosure as set forth herein supersedes any conflicting material incorporated by reference herein. Any material, or portion thereof, that is said to be incorporated by reference herein, but which conflicts with existing definitions, statements, or other disclosure material set forth herein is only incorporated to the extent that no conflict arises between that incorporated material and the existing disclosure material. Applicant reserves the right to amend the present disclosure to expressly recite any subject matter, or portion thereof, incorporated by reference herein.

It is to be understood that all embodiments described herein are exemplary, illustrative, and non-limiting. Thus, the invention is not limited by the description of the various exemplary, illustrative, and non-limiting embodiments. The various embodiments disclosed and described herein can comprise, consist of, or consist essentially of, the features, aspects, characteristics, limitations, and the like, as variously described herein. The various embodiments disclosed and described herein can also comprise additional or optional features, aspects, characteristics, limitations, and the like, that are known in the art or that may otherwise be included in various embodiments as implemented in practice.

The present disclosure has been written with reference to various exemplary, illustrative, and non-limiting embodiments. However, it will be recognized by persons having ordinary skill in the art that various substitutions, modifications, or combinations of any of the disclosed embodiments (or portions thereof) may be made without departing from the scope of the invention as defined solely by the claims. Thus, it is contemplated and understood that the present disclosure embraces additional embodiments not expressly set forth herein. Such embodiments may be obtained, for example, by combining, modifying, or reorganizing any of the disclosed steps, ingredients, constituents, components, elements, features, aspects, characteristics, limitations, and the like, of the embodiments described herein. Thus, this disclosure is not limited by the description of the various exemplary, illustrative, and non-limiting embodiments, but rather solely by the claims.

What is claimed is:

1. A system, comprising:

an electric heating element assembly, comprising:

a sheath;

a resistive wire comprising a first resistive coil and a second resistive coil;

a first conductor pin that extends from the first resistive coil;

a second conductor pin that extends from the second resistive coil;

a first electrically insulative sleeve that surrounds a portion of the first conductor pin;

a second electrically insulative sleeve that surrounds a portion of the second conductor pin; and a dielectric core positioned within the sheath, wherein the dielectric core comprises:

an electrically insulative outer tubular body comprising a first end and at least three axially-aligned outer components arranged adjacently end-to-end such that there is a boundary between each pair of adjacent outer components;

an electrically insulative inner body positioned within the outer tubular body, wherein the inner body defines a length, and wherein the inner body comprises:

first and second interior passageways extending in parallel lengthwise along the length of the inner body, wherein the first resistive coil is positioned in the first interior passageway and the second resistive coil is positioned in the second interior passageway;

a second end, wherein the second end is longitudinally offset from the first end of the outer tubular body; and at least three axially-aligned inner components arranged adjacently end-to-end such that there is a boundary between each pair of adjacent inner components, wherein the boundaries of the inner components are longitudinally staggered relative to the boundaries of the outer components; and a groove-and-notch interface between the inner body and the outer tubular body that prevents axial rotation of the inner body relative to the outer tubular body; and a voltage source connected to the resistive wire that supplies a voltage to the resistive wire that is between 600 volts and 38,000 volts, inclusive.

2. The electric heating element assembly of claim 1, wherein the groove-and-notch interface comprises the inner body comprising a longitudinal groove and the outer tubular body comprising a longitudinal notch positioned in the longitudinal groove.

3. The electric heating element assembly of claim 1, wherein the dielectric core comprises a dielectric material selected from a group consisting of boron nitride, aluminum oxide, and magnesium oxide.

4. The electric heating element assembly of claim 1, wherein the groove-and-notch interface prevents axial rotation of the inner components relative to the outer components.

5. The electric heating element assembly of claim 1, further comprising a bushing, wherein the bushing comprises:

a first end portion abutting the inner body of the dielectric core and positioned within the outer tubular body of the dielectric core; and a second end portion extending from the sheath.

6. The electric heating element assembly of claim 5, wherein the bushing further comprises third interior passageway between the first end portion of the bushing and the second end portion of the bushing, and wherein the first conductor pin extends through the third interior passageway.

7. The electric heating element assembly of claim 6, wherein the sheath comprises:

a first end, wherein the bushing seals the first end of the sheath; and a second end, wherein a terminating disk seals the second end of the sheath.

8. An electric heating element assembly, comprising:

a sheath;

an outer dielectric tubular body positioned at least partially through the sheath, wherein the outer dielectric tubular body comprises at least three outer segments extending adjacently end-to-end along a longitudinal axis such that there is a boundary between each pair of adjacent outer segments;

an inner dielectric body positioned at least partially through the outer dielectric tubular body, wherein the inner dielectric body comprises at least three inner segments extending adjacently end-to-end along the longitudinal axis such that there is a boundary between each pair of adjacent inner segments, and wherein the boundaries of the inner segments are longitudinally offset relative to the boundaries of the outer segments;

a resistive wire positioned at least partially through the inner dielectric body;

a conductor pin extending from the resistive wire; and an electrically insulative sleeve that surrounds a portion of the conductor pin.

9. The electric heating element assembly of claim 8, further comprising a groove-and-notch interface between the outer dielectric tubular body and the inner dielectric body that prevents axial rotation of the inner segments relative to the outer segments.

10. The electric heating element assembly of claim 8, wherein the resistive wire comprises a first length, a second length parallel to the first length, and a u-shaped portion between the first and second lengths.

11. The electric heating element assembly of claim 10, further comprising a bushing, wherein the bushing comprises:

a first end abutting the inner dielectric body and positioned within the outer dielectric tubular body; and a second end extending out of the sheath.

12. An electric heating element assembly, comprising:

a sheath;

a dielectric core positioned within the sheath, wherein the dielectric core comprises a plurality of nested bodies, and wherein the plurality of nested bodies comprises:

three or more outer bodies arranged adjacently end-to-end along a longitudinal axis such that there is a boundary between each pair of adjacent outer bodies, wherein one of the outer bodies comprises an outer body end; and three or more inner bodies arranged adjacently end-to-end along the longitudinal axis such that there is a boundary between each pair of adjacent inner bodies, wherein the boundaries of the inner bodies are longitudinally offset relative to the boundaries of the outer bodies, and wherein one of the inner bodies comprises an inner body end;

a pair of resistive wires positioned within the inner bodies of the dielectric core;

a conductor pin extending from each resistive wire;

an electrically insulative sleeve positioned around at least a portion of each conductor pin; and a unitary insulative bushing, comprising:

a first end abutting the inner body end;

a sealing interface abutting the outer body end; and a second end extending from the sheath.

13. The electric heating element assembly of claim 12, wherein the bushing further comprises a pair of interior passageways between the first and second ends of the bushing, and wherein each conductor pin extends through one of the interior passageways of the bushing.

14. The electric heating element assembly of claim 12, further comprising a groove-notch engagement between one of the outer bodies and the bushing that prevents axial rotation of the outer body relative to the bushing.

15. The electrical heating element assembly of claim 1, wherein the dielectric core comprises a pair of nested cylinders, and wherein the pair of nested cylinders comprises the outer tubular body and the inner body.

16. The electric heating element assembly of claim 8, wherein the outer dielectric tubular body and the inner dielectric body form a pair of nested cylindrical cores.

17. The electric heating element assembly of claim 12, wherein the outer bodies comprise a tubular body.

18. The electric heating element assembly of claim 13, wherein the inner bodies comprise a cylindrical body.

19. The electric heating element assembly of claim 1, wherein an outer surface of the electrically insulative inner body faces an inner surface of the electrically insulative outer tubular body without an electrically conductive layer therebetween.

20. The electric heating element assembly of claim 8, wherein an outer surface of the inner dielectric body faces an inner surface of the outer dielectric tubular body without an electrically conductive layer therebetween.

21. The electric heating element assembly of claim 12 wherein an outer surface of each inner body faces an inner surface of each outer body without an electrically conductive layer therebetween.

* * * * *